US005467687A

United States Patent [19]

Habegger

[11] Patent Number: 5,467,687

[45] Date of Patent: Nov. 21, 1995

[54] PISTON COMPRESSOR

[75] Inventor: Oskar Habegger, Therwil, Switzerland

[73] Assignee: Maschinenfabrik Sulzer Burckhardt AG, Basel, Switzerland

[21] Appl. No.: 282,396

[22] Filed: Jul. 28, 1994

[30] Foreign Application Priority Data

Aug. 25, 1993 [EP] European Pat. Off. ..... 93810606

[51] Int. Cl.[6] ..... F16J 15/18

[52] U.S. Cl. ..... 92/165 R; 74/44; 384/11

[58] Field of Search ..... 92/165 R, 139; 74/44; 384/11

[56] References Cited

U.S. PATENT DOCUMENTS 1,520,853 12/1924 Cable .
2,000,970 5/1935 McAllister .
2,606,531 8/1952 Hedges ..... 74/44
4,189,958 2/1980 Braun ..... 74/44
4,338,037 7/1982 Deminski ..... 403/24
4,494,415 1/1985 Elliston ..... 74/44
5,031,512 7/1991 Graziani ..... 384/11

*Primary Examiner*—Thomas E. Denion
*Attorney, Agent, or Firm*—Townsend and Townsend and Crew

[57] ABSTRACT

The piston compressor has at least one cylinder (11) and a piston (10) guided therein in contact-free manner, which is connected via a piston rod (8) to a crosshead (6). The piston rod consists of a pipe (8) extending between the crosshead (6) and the piston (10). In this pipe extends a tension rod (9), which can be extended by means of a hydraulic stretching device (30) and under prestressing pulls the crosshead and the piston towards the pipe.

12 Claims, 2 Drawing Sheets

PISTON COMPRESSOR

BACKGROUND OF THE INVENTION

The invention relates to a piston compressor having at least one cylinder and a piston guided therein in contact-free manner, which connected via a piston rod to a crosshead.

In piston compressors of this type the connection of the piston rod to the crosshead consists either of two nuts screwed to the piston rod, which can be screwed in relation to one another and between them clamp a wall part of the crosshead body which has correspondingly thick dimensions. Another possibility for the connection consists in the provision of a slot at right angles through the piston rod end and the crosshead body receiving said end, into which slot two wedges mutually abutting with their wedge faces can be inserted. Both embodiments have the disadvantage that with regard to the type of connection the crosshead body has to be constructed so that it is longer than would be necessary with regard to the length of its bearing surface in the cross head bearing. The distance between crosshead journal and the piston centre is consequently relatively large. This in turn necessitates the overall length of the compressor being great and the piston, which is guided in contact-free manner, having a tendency to perform relatively large radial movements.

In order to rectify this situation, in addition a piston rod guide bearing was previously installed between the crosshead bearing and the cylinder, which necessitates a large length of the piston rod and thus also of the compressor.

SUMMARY OF THE INVENTION

It is object of the invention to improve a compressor of the aforementioned type so that the overall length of the compressor is reduced, so that an occurrence of movements of the piston at right angles its normal movement is considerably reduced.

This object is achieved in accordance with the invention in the piston rod consists of a pipe extending between the crosshead and the piston and in that in this pipe is disposed an extensible tension rod, which under prestressing pulls the crosshead and the piston in a tensioned manner towards the pipe. Since the piston rod now has the form of a pipe, the diameter of the piston rod is substantially increased, as a result of which greater rigidity is achieved and the tendency for the piston to perform transverse movements is practically eliminated. A piston rod guide bearing, which was previously necessary, is omitted in the new compressor. Because of the fact that the connection between the tubular piston rod and the crosshead is achieved by means of a tension rod subject to prestressing, the piston rod can be shorter than before, as a result of which, together with the omission of a piston rod guide bearing, the compressor has a shorter overall length. The invention can be used both in piston compressors having a vertical piston motion and also in piston compressors having a horizontal piston motion. In the latter case there is the advantage that because of the increased diameter of the tubular piston rod, practically no excursion of the piston occurs under its own weight.

An exemplified embodiment of the invention is explained in further detail in the following description by means of the drawings.

DESCRIPTION OF THE PREFERRED EMBODIMENTS

Figure 1:
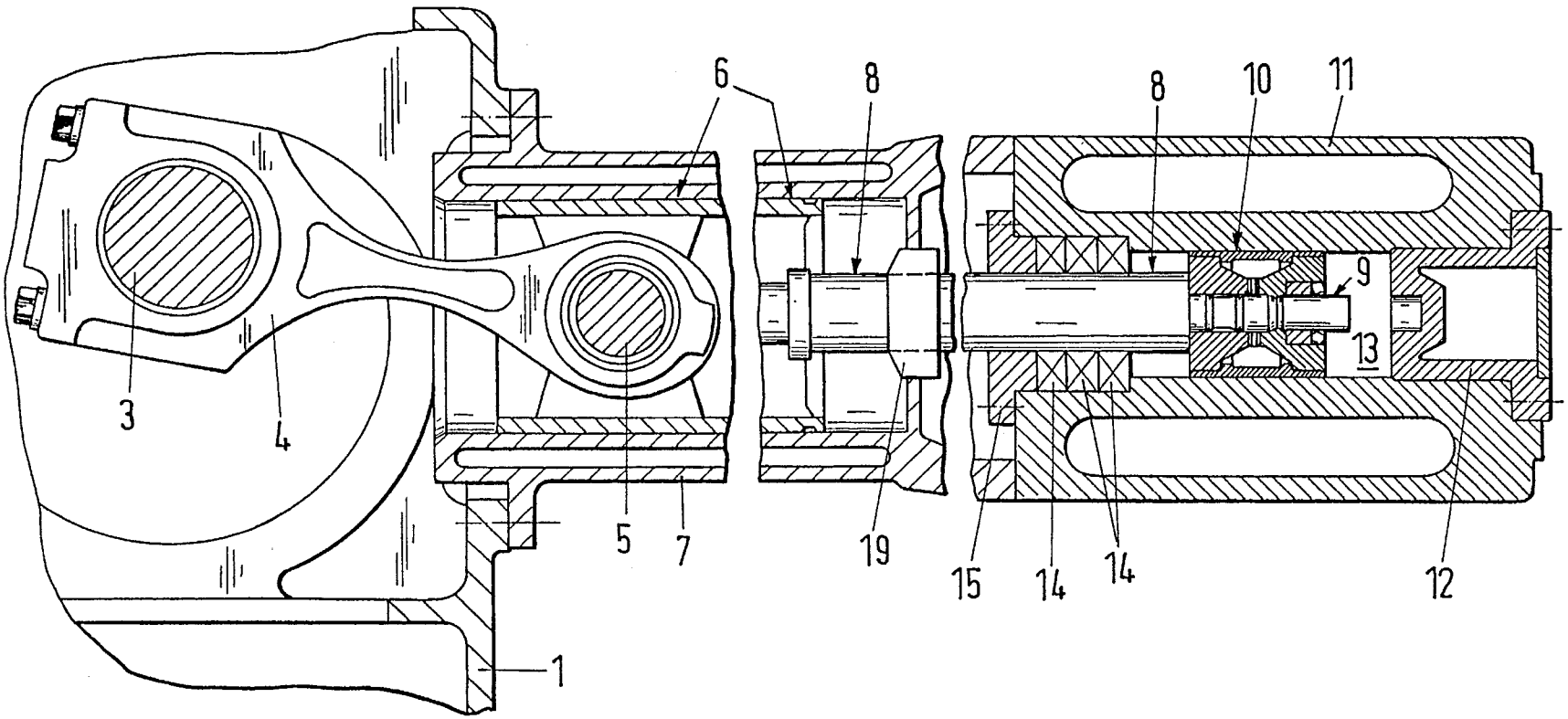
FIG. 1 shows a diagrammatically simplified longitudinal section through a piston compressor of the horizontal type and FIG. 2 also shows a longitudinal section through the assembly unit consisting of crosshead, piston rod, piston and tension rod with a hydraulic tensioning device placed thereon.

As shown in FIG. 1 the piston compressor comprises a crankcase 1, which is only partially represented and in which a crankshaft (not represented in further detail) is mounted in a known manner. To a crank pin 3 of the crankshaft is connected a connecting rod 4, which at its right-hand end in FIG. 1 is hinged to a pin 5, which is part of a crosshead 6 which moves horizontally to and fro in a straight line. The crosshead 6 is mounted in a fluid-cooled housing 7, which is flange-mounted on the crankcase 1. On the right-hand end of the crosshead 6 in FIG. 1 is attached a tension rod 9 in a manner described in further detail below, which extends through a piston rod 8 in the form of a pipe and a piston 10 and which holds together the three components 6, 8 and 10. The piston 10 is guided in a fluid-cooled cylinder 11 without contact, but this is not represented in FIGS. 1 and 2. The piston rod 8 is surrounded by an oil scraper device 19, which prevents lubricating oil from the crankcase 1 being conveyed via the crosshead 6 and the piston rod to the cylinder 11.

At its right-hand end in FIG. 1 the cylinder 11 is closed by a fluid-cooled cylinder head 12. In the cylinder 11, between the piston 10 and the cylinder head 12, is located the working chamber 13, in which gas is taken in and then compressed during the operation of the compressor. The suction and pressure valves are not represented in the drawings. At the left-hand end of the cylinder 11 in FIG. 1, the piston rod 8 is surrounded in a known manner by annular sealing elements 14, which are fixed by means of a packing box gland 15 in the cylinder 11.

Figure 2:
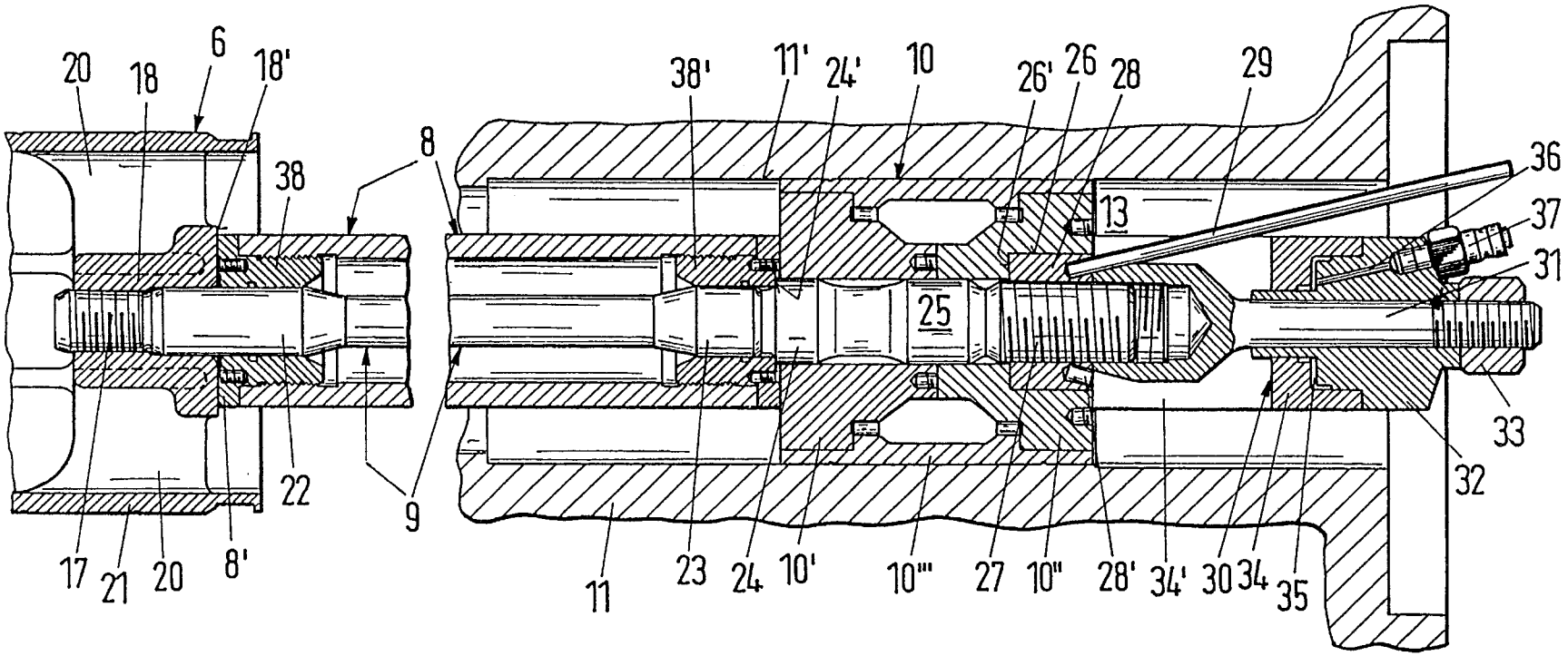

As shown in FIG. 2, the tension rod 9 extending through the piston rod 8 and the piston 10 comprises at its left-hand end a threaded portion 17, which is screwed into a matching threaded portion of a hub-type part 18 of the crosshead 6. The hub-type part 18 is connected via several ribs 20 to a cylindrical portion 21 of the crosshead sliding in the housing 7. The end of the hub-type part 18 close to the piston rod 8 is enlarged in the manner of a flange and with its end face 18' forms a supporting face for the piston rod 8. At its end close to part 18 the tubular piston rod 8 is provided with a ring nut 38, which is screwed into the pipe and abuts with a flange 8' firstly against the end face of the pipe and secondly against the supporting face 18'. The ring nut 38 rests with its central bore on a thickened portion of the tension rod 9. In the same manner to the other pipe end of the piston rod 8 is screwed a ring nut 38', which rests with its central bore on a thickened portion 23 of the tension rod 9. The flange of the ring nut 38' here protrudes between the right-hand end face in Figure 2 of the piston rod 8 and the left-hand end face of the piston 10.

In this example the piston 10 is assembled from three parts 10', 10" and 10'". Part 10" forms the piston body and at its outer surface comprises known labyrinth grooves (not represented here), which together with the surrounding cylindrical surface 11' of the cylinder 11 produce a contact-free labyrinth seal. The body part 10'" of the piston 10 is held between two shoulders of the inner piston parts 10' and 10". The two parts 10' and 10" comprise a central bore, the internal diameter of which is greater than the diameter of the thickened portion 23 of the tension rod 9. With this bore the parts 10' and 10" rest on correspondingly thickened portions 24 and 25 of the tension rod 9, whereby at the left-hand end of portion 24 there is constructed a shoulder 24', which interacts with a slightly recessed counter-face at the flange of the ring nut 38'.

The part 10" of the piston 10 close to the working chamber 13 comprises at its right-hand end in FIG. 2 a cylindrical bored part 26, which forms a shoulder 26' and is used to receive a nut 28, which is screwed on to a threaded portion 27 of the tension rod 9. The threaded portion 27 protrudes slightly in relation to the right-hand end face of the piston 10.

This protruding threaded portion 27 is used to receive a hydraulic clamping device 30. The clamping device consists of a central shaft-type part 31, which is screwed with a nut-type end portion onto the threaded portion 27 and on which a clamping piston 32 is disposed, which is fixed with a nut 33 on part 31. The clamping piston 32 protrudes into a clamping cylinder 34 surrounding it, which is supported via two elevated parts 34', of which only one can be seen in FIG. 2, on the right-hand end face of part 10". Between the clamping piston 32 and the clamping cylinder 34 is provided a pressure chamber 35, into which a duct 36 opens, to which a hydraulic fluid supply 37 is connected. To rotate the nut 28 a cylindrical rod 29 is provided, which can be inserted in correspondingly inclined pocket bores 28' distributed over the periphery of the nut.

The assembly of crosshead 6, piston rod 8 and piston 10 occurs in the following manner: With the cylinder head 12 still removed and the piston 10 dismantled, the tension rod 9 with the piston rod 8 placed over it is inserted into the cylinder 11 and the tension rod 9 is screwed with its threaded portion 17 into the hub-type part 18 of the crosshead 6. In this state the shoulder 24' of the tension rod, which abuts the recessed counter-face of the ring nut 38', presses the piston rod 8 with the flange 8' against the supporting face 18' at the crosshead. Then parts 10', 10''' and 10" of the piston are inserted one after the other over the threaded portion 27 into the cylinder 11, until the piston 10 in its entirety with its left-hand end face in FIG. 2 abuts the right-hand end face of the ring nut 38' of the piston rod 8. Then the nut 28 is screwed onto the threaded portion 27 until it abuts shoulder 26'. Finally the shaft-type part 31 of the hydraulic clamping device 30 is screwed onto the protruding threaded portion 27, and the clamping cylinder 34 and the clamping piston 32 are placed onto the shaft-type part 31 and fixed by means of nut 33. By supplying hydraulic fluid under a pressure of at least 100 bar into the pressure chamber 35, the tension rod 9 is extended, as a result of which a gap is produced between the shoulder 26' and the nut 28. By means of the rod 29 the nut 28 is now rotated until it again abuts the shoulder 26'. After the hydraulic fluid leaves the pressure chamber 35, the crosshead 6, piston rod 8 and piston 10 are now held together under prestressing by the extended tension rod. If necessary the extension operation described can be repeated by using the clamping device 30, until the desired prestressing in the tension rod and in the piston rod has been achieved. After releasing the hydraulic clamping device 30 from the threaded portion 27 and the removal of the rod 29, the cylinder head 12 is mounted in the cylinder 11 and the compressor can be brought into operation.

By the new connection of the piston to the crosshead via the tubular piston rod 8, an excursion of the piston 10 under its own weight is largely avoided, so that despite the contact-free guidance of the piston in the cylinder 11, the centered arrangement of the piston is retained in practice.

Deviating from the example described, it is also possible, instead of the ring nuts 38 and 38', to provide corresponding thickened wall portions at the ends of the pipe 8, so that as a unit it is in one piece. It is also possible instead of shoulder 24' to mount at the tension rod 9 a conical face, which tapers towards the crosshead, and at the corresponding end of the piston rod 8 to provide a matching counter conical face.

I claim:

1. A piston compressor comprising a cylinder having a longitudinal axis, a piston reciprocably movably disposed in the cylinder, and means guiding the piston so that the piston reciprocates in the cylinder substantially without contact between the piston and the cylinder, the guiding means including a crosshead adapted to be connected to a connecting rod driven by a rotating crankshaft, the crosshead being guided for linear movement coaxial to the piston axis, a tubular compression member and a prestressed tensioning rod coaxially connecting the piston and the crosshead, and means rigidly coupling the piston, the compression member, the tensioning rod and the crosshead in a manner preventing relative lateral displacements between the crosshead and the piston so that the crosshead guides the piston when it reciprocates in the cylinder to thereby substantially prevent contact between them.

2. A piston compressor according to claim 1, including prestressing means demountably attachable to the piston and the tensioning rod for subjecting the tensioning rod to a tensioning force, the prestressing means including a fluid pressure activated clamping device for elongating the tensioning rod relative to the compression member, and means for fixing the tensioning member in its elongated condition relative to the compression member while the clamping device applies the tensioning force to the tensioning rod.

3. A piston compressor according to claim 2 wherein the fixing means comprises a nut threaded onto a threaded end of the tensioning rod remote from the crosshead.

4. A piston compressor according to claim 3, wherein the clamping device includes means for threadably attaching it to the threaded end of the tensioning rod.

5. A piston compressor comprising a cylinder having a longitudinal axis, a piston reciprocably movably disposed in the cylinder, a crankshaft driven crosshead reciprocating coaxially to the cylinder axis, a piston rod rigidly and laterally immovably mounting the piston to the crosshead so that the crosshead guides reciprocating movements of the piston and substantially prevents contact between the reciprocating piston and the cylinder, the piston rod including a tubular compression member and a tensioning rod, prestressing means for applying sufficient tension to the tensioning rod to effect said laterally immoveable mounting of the piston, the prestressing means including a device located on a side of the piston remote from the crosshead and detachably connected to the tensioning rod and the compression member for elastically elongating the tensioning rod relative to the compression member to thereby prestress the tensioning rod, and means for fixing the elastically elongated tensioning rod relative to the compression member while the device applies the tensioning force.

6. A piston compressor according to claim 5, wherein an axis of the cylinder is horizontally disposed.

7. A piston compressor according to claim 5, wherein the axis of the cylinder is non-horizontally disposed.

8. A piston compressor according to claim 7 wherein the axis of the cylinder is vertically disposed.

9. A piston compressor according to claim 5, wherein the prestressing means includes a pressurized fluid energized actuator.

10. A piston compressor according to claim 5 wherein an end of the tensioning rod remote from the crosshead is threaded, and wherein the fixing means and the prestressing means include threaded portions engaging the threaded end of the tensioning rod.

11. A piston compressor according to claim 5 wherein the rigidly coupling means comprises cooperating contact surfaces on the compression member and on the crosshead and the piston, respectively, which are flat and perpendicular to the axis.

12. A piston compressor according to claim 1 wherein the rigidly coupling means comprises cooperating contact surfaces on the compression member and on the crosshead and the piston, respectively, which are flat and perpendicular to the axis.

* * * * *